United States Patent [19]

Spilde

[11] Patent Number: 4,597,324

[45] Date of Patent: Jul. 1, 1986

[54] ACTIVE RIDGE VENT

[76] Inventor: Rodney Spilde, 6300 W. Richmond Rd., Aberdeen, S. Dak. 57401

[21] Appl. No.: 599,777

[22] Filed: Apr. 13, 1984

[51] Int. Cl.[4] ..... F24F 13/14

[52] U.S. Cl. ..... 98/42.16; 74/96; 251/303

[58] Field of Search ..... 236/49; 98/85, 92.14, 98/42.16, 42.2; 251/212, 294, 303; 74/96

[56] References Cited

U.S. PATENT DOCUMENTS

| | | | |
|---|---|---|---|
| 87,668 | 3/1869 | Hayes | 98/85 X |
| 919,673 | 4/1909 | Anderson | 98/85 X |
| 1,410,625 | 3/1922 | Sylvan | 98/85 X |
| 1,618,792 | 2/1927 | Wood et al. | 98/42.2 X |
| 1,952,350 | 3/1934 | Armstrong | 236/49 X |
| 2,009,870 | 7/1935 | Black | 98/85 |
| 2,519,239 | 8/1950 | Eddison et al. | 236/49 |
| 2,538,319 | 1/1951 | Moore | 98/85 |
| 3,323,438 | 6/1967 | Korff | 98/42.16 X |
| 3,417,961 | 12/1968 | Schorrock | 251/212 |

*Primary Examiner*—William E. Tapolcai
*Attorney, Agent, or Firm*—Malcolm Reid

[57] ABSTRACT

An active ridge vent designed for providing varying degrees of ventilation at the ridge of a building such as a livestock building. An arm in combination with a triangular member, a linkage, and a channel allow the opening created by two opposed doors which are hinged to the open peak of a gable roof to vary. The opening is designed to vary in accordance with the temperature level in the livestock building.

7 Claims, 4 Drawing Figures

ACTIVE RIDGE VENT

BACKGROUND OF THE INVENTION

1. Field of the Invention

This invention relates generally to an adjustable ridge vent for ventilation of buildings.

2. Description of Prior Art

It is standard practice to use vents on the roofs of a building to provide ventilation of the closed off portion of a building between the gable roof and the horizontal gable roof stablizing joist. It is also standard practice in those buildings where that portion of the roof between the roof joist and the actual roof itself is not closed off to use the roof vents to provide a certain amount of ventilation for the entire building. It is well known that the moisture in building tends to rise to the highest point of the building and that the warmer air in the building also tends to rise.

Roof vents are typically of the passive type. That is, the roof vent simply provides an opening from the inside of the building through the roof to the outside of the building of an unvarying size. However, ventilation needed in any particular building to aid in the control of the temperature in that building will vary depending upon the outside temperature. Therefore, a vent whose opening varies in accordance with the temperature conditions on the outside of the building relative to those existing on the inside of the building would greatly aid in the proper ventilation of the building and thereby aid in the control of the temperature in the building.

Generally the roof vents which are used are mounted at a point in the roof other than the peak of the roof. This results in inadequate ventilation of that volume of the building which lies between the peak of the roof and the level at which the roof vents are located. Therefore, in conjunction with an adjustable roof vent, a roof vent which is located at the ridge results in superior ventilation and temperature control.

The present invention overcomes the shortcomings and deficiencies of the prior art roof vents by providing a simple, efficient, flexible and highly reliable active ridge vent particularly suitable for application in combination with a completely automatic system of ventilation and temperature control in buildings such as those used for rearing of livestock. The active ridge vent of this invention is adaptable to use with any thermostat controlled environment.

BRIEF DESCRIPTION OF THE DRAWINGS

Referring to the drawings, where like numerals represent like parts throughout the several views.

DESCRIPTION OF THE PREFERRED EMBODIMENT

Figure 1:
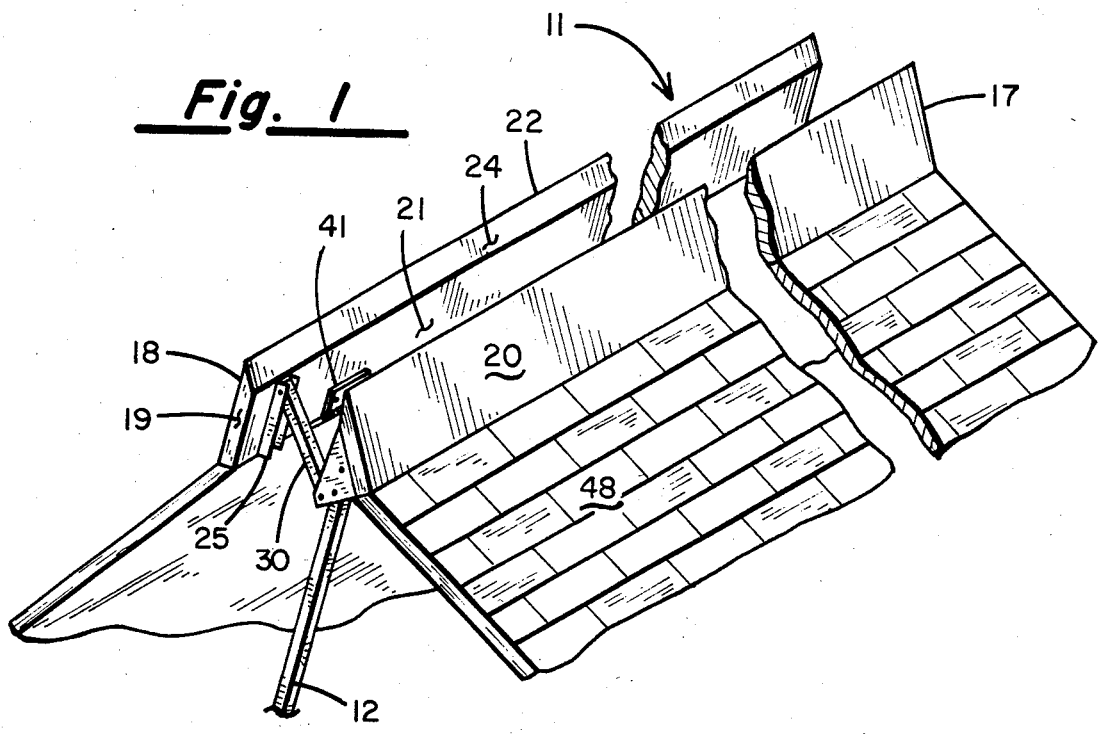
FIG. 1 is a diagramatic view of a preferred embodiment configuration of an active ridge vent constructed according to the principles of this invention and mounted over a suitable opening at the peak of a gable roof.

Referring to the Figures, there is generally illustrated at 11, in FIG. 1, an active ridge vent configured for use in combination with an opening in a gable roof 48 and a means of activation responsive to the interior temperatures of the building on which the active ridge vent 11 is mounted. The active ridge vent 11 of the present invention includes a first door 17 and a second door 18 which are opposed to each other. Each of these doors 17 and 18 is mounted at an opening made at the peak of a gable roof 48. The mounting of the doors 17 and 18 is accomplished by attaching a hinge set 41 which is mounted to each of the respective doors 17 and 18 and to each side of the opening in the roof so that the doors 17 and 18 are pivotally mounted opposite one another. An angled surface 24 is provided on each door 17 and 18 so that the angle slants inward from the apex 22 of the door 17 or 18 towards the bottom 21 of the door 17 or 18. When the doors 17 and 18 are pivoted into a closed position, the apex 22 of each door 17 and 18 meet. This allows for complete closure of the active ridge vent 11. At the end 23 of each door 17 and 18, are mounted two pieces of flexible flashing material 49. When the doors 17 and 18 of the active ridge vent 11 are mounted to the roof 48, the upper piece of flashing 49 is allowed to lay over the roofing material to prevent moisture from entering between the roof 48 and the ends 23 of the doors 17 and 18. The upper flashing 49 acts as a moisture deflector.

Figure 2:
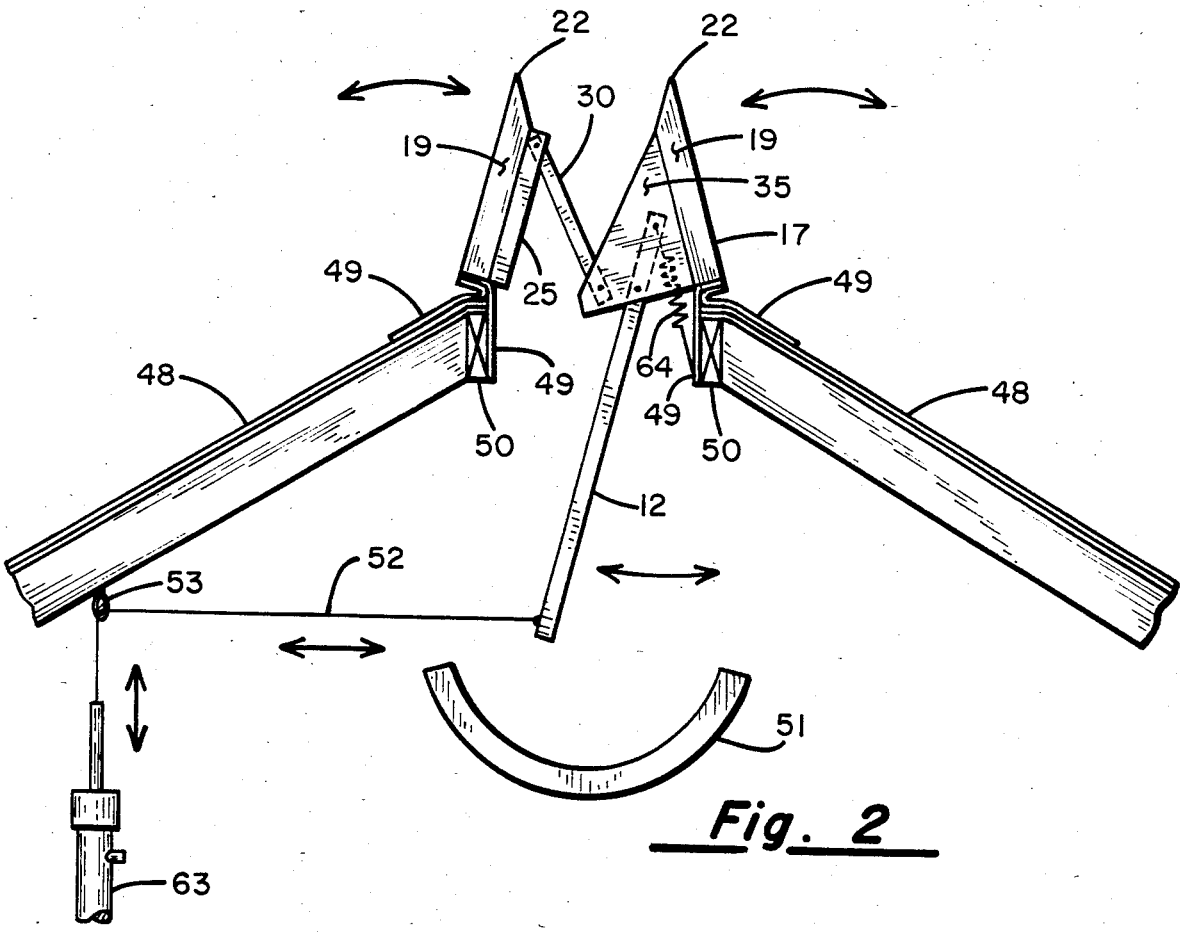
FIG. 2 is an end view of the active ridge vent of this invention illustrated as it would be installed in an opening at the peak of a gable roof in combination with a means for activating the active ridge vent responsive to the temperature within the building.
Figure 3:
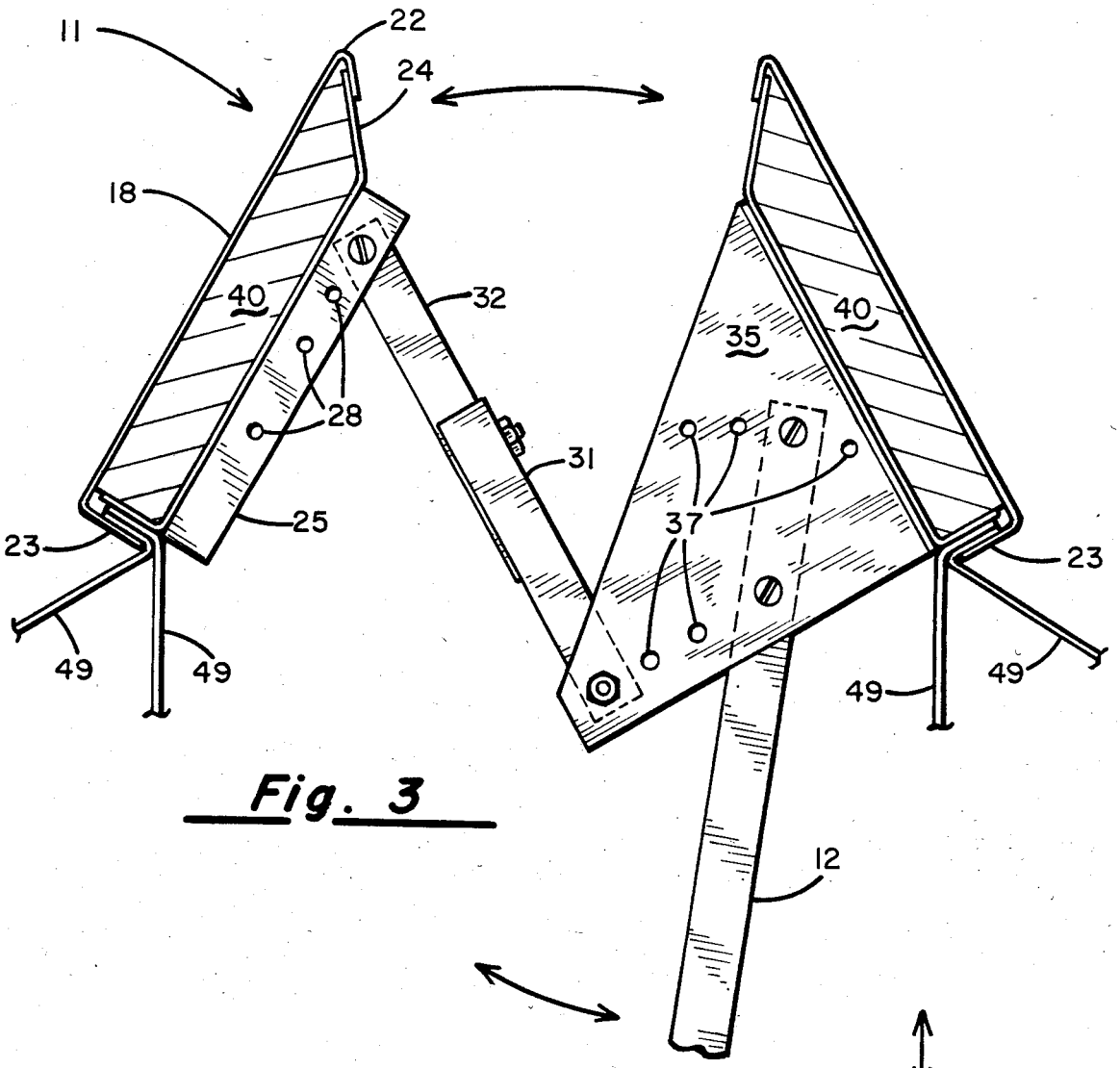
FIG. 3 is a partial cross-sectional view of the active ridge vent shown in an unmounted condition.

Arm 12 is fixedly connected to the triangular mounting member 35 which is mounted on door 17. Triangular mounting members 35 contain a number of adjustment holes 37 to allow for the most appropriate degree of travel of the arm 12 given any particular mounting configuration which may be dictated by the building to be ventilated. Linkage 30 is pivotably mounted to triangular mounting member 35 as shown in FIG. 2. The opposite end of linkage 30 is pivotably mounted to channel bracket 25 which in turn is fixedly mounted to door 18. Channel bracket 25 contains a series of channel adjustment holes 28 as shown in FIG. 3. Linkage 30 may be mounted in any of these channel adjustment holes 28, depending on the mounting dimensions dictated by the building to be ventilated. Linkage 30 likewise has a means for adjustment. Linkage 30 is composed of a female member 31 and a male member 32 as illustrated in FIG. 3. The male member 32 slides within the female member 31 to allow for adjustment of the length of the linkage 30. Once the length adjustment of linkage 30 is determined, the male and female members 32 and 31 are bolted together as illustrated in FIG. 3.

In the preferred embodiment the doors 17 and 18 are constructed of aluminum sheet metal which surrounds commercially available foam insulation 40, thereby providing for a minimum amount of heat loss during the coldest weather when the active ridge vent 11 is in the completely closed position.

Spring 64 connects between the triangular mounting member 35 and a point on the flashing 49 at the ridge purlin 50 which allows slight tension on the spring 64 when the active ridge vent 11 is in the closed position as shown in FIG. 2. Spring 64 being connected in this manner biases the active ridge vent 11 in a closed position as may be seen in FIG. 2.

Figure 4:
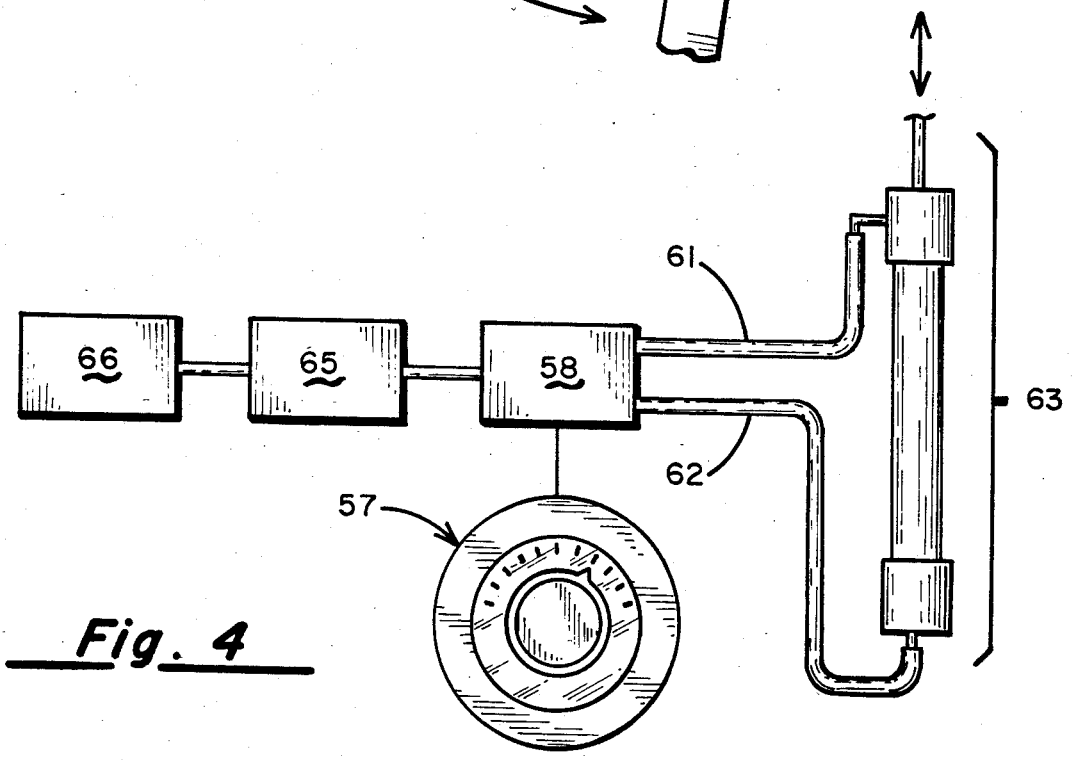
FIG. 4 is a schematic view of a temperature controlled means of activating active ridge vent.

A means for regulating the opening existing between the two doors 17 and 18 in accordance with the interior temperature of the building may be accomplished using the thermostat control system illustrated in FIG. 4. FIG. 4 shows a thermostat 57 which electrically switches an air valve 58 between one of two positions depending upon whether the actual temperature in the building is above or below the temperature preset on the thermostat. The air valve 58 switches a source of compressed air provided by air tank 65 and air compressor 66 to a first air line 61 or a second air line 62. Both of these air lines 61 and 62 are connected to a double acting pneumatic assembly 63. The air compressor 66, the air tank 65, the electrically actuated air valve 58, the thermostat 57, the air lines 61 and 62, and the pneumatic assembly 63 are all commercially available components. Depending upon the actual temperature, the thermostat control system 56 may allow air into either the first air line 61 or the second line 62 causing the plunger of the pneumatic assembly 63 to either extend or retract as the case may be. Connected to the end of the plunger of the pneumatic assembly 63 is a cable 52 which is connected through an eyelet 53 to the arm 12 as shown in FIG. 2. Since the doors 17 and 18 are normally biased in a closed position by spring 64, as the pneumatic assembly 63 retracts, the arm 12 is pulled to the left as shown in FIG. 2 thereby opening doors 17 and 18. The doors 17 and 18 move toward opening as the temperature in the building increases above a preset level. As the temperature in the building begins to decrease, the plunger of the pneumatic assembly 63 begins to extend. As the plunger is extended, the biasing spring 64 pulls the doors 17 and 18 into a more closed condition. The pneumatic assembly 63 to be used with the present invention, is designed so that the plunger of the pneumatic assembly 63 has a continuum of extension or retraction so that doors 17 and 18 can extend along a continuum from fully closed, to very slightly open, to ever greater degrees of openness, to fully opened; the ventilation in the building being thereby changed only to the degree necessary to bring the temperature in line with a preset level. If the doors 17 and 18 could only be adjusted to fully open or fully closed, the ventilation changes within the building would be abrupt and would never reach a steady state condition thereby causing the doors 17 and 18 to be constantly opening and closing.

It has been found that using the active ridge vent 11 of the present invention allows a naturally ventilated building to exhaust warm, moist air at its highest point. As the warm air exhausts, it creates a negative pressure inside the building which causes fresh air to intake at windows, doors or wall vents placed in the walls of the building. Constant adjustment of the degree of ridge opening responsive to the difference between the inside temperature of the building as compared to a preset level insures a constant temperature within the building.

In extremely cold weather, it has been found that a setting which does not allow the active ridge vent 11 opening to be completely closed is a most efficacious setting. A small opening allows certain amount of warm, moisture-laden air to exhaust from the building. This allows the removal of moisture from the building with only minimal heat loss. It has been found that with the use of the active ridge vent 11, a properly insulated livestock building can have a steady, acceptable temperature level without the addition of a source of heat except the heat given off by the livestock.

During high temperature times of the year, the active ridge vent 11 is substantially open. This larger opening allows a free air exhaust which removes warm, moist air from the building. The warm, moist air is replaced at wall vents, windows, or the doors by the intake of cooler, dryer air aiding in the maintenance of the preset temperature level in the building.

During times of the year other than the extreme cold periods or the extreme hot periods, incremental active ridge vent 11 adjustments will be made frequently to maintain the desired temperature. The degree of opening will be something less than fully open and something more than fully closed.

The active ridge vent 11 may be manually controlled a well as automatically controlled.

The adjustable arm 12 in combination with the triangular mounting member 35, the linkage 30 and the channel 25 allows the doors 17 and 18 to move simultaneously in a semi-ellipitcal, opposing manner. The length of the active ridge vent 11 to be used with any particular building is to be determined based upon the calculation of the volume of air in the building along with other factors. In some situations, the active ridge vent 11 may extend the full length of the peak of the roof 48. In other installations, the active ridge vent 11 will extend substantially less than the full length of the peak of roof 48.

In extremes of cold, warm, moist exhausting air may cause condensation at the ridge opening. Likewise, a summer downpour may require that an eave trough 51 be suspended beneath the active ridge vent 11. A PVC pipe, split in half, as shown at 51 in FIG. 2 may be suspended below the active ridge vent 11 to capture this moisture. The eave trough 51 should be placed far enough below the active ridge vent 11 so that it will not interfere with the movement of the ridge vent 11 or impede air flow.

While we have disclosed a preferred embodiment description and application of the invention, other modifications of the invention not specifically disclosed or referred to will be apparent to those skilled in the art in light of the foregoing description. This description is intended to provide a concrete example of a preferred embodiment structure and application clearly disclosing the present invention and its supportive principles. Accordingly, the invention is not limited to any particular embodiment or configuration of component parts thereof. All alternatives, modifications and variations of the present invention which fall within the spirit and broad scope of the appended claims are covered.

What is claimed is:

1. An active ridge vent for use in combination with a building temperature control system which comprises:

(a) A first door having a mounted member pivotally mounted to one side of an opening at the peak of a gable roof;

(b) An arm connected to the mounting member;

(c) A second door pivotally mounted to the opposite side of the opening at the peak of the gable roof; and (d) A linkage pivotally connected to the first door and pivotally connected to the second door so that when the arm is moved in one direction, the first and second doors move away from one another and when the arm is moved in an opposite direction, the first and second doors move towards each other.

2. The active ridge vent of claim 1, further comprising a means to bias the active ridge vent in the closed position.

3. The active ridge vent of claim 2, wherein the biasing means is a spring connected between one of the doors and the gable roof opening.

4. The active ridge vent of claim 1, wherein each door has an angle surface extending between the door apex and the door bottom.

5. The active ridge vent of claim 1, wherein the doors contain insulation in their interiors.

6. The active ridge vent of claim 1, wherein the linkage is connected to the mounting member.

7. The active ridge vent of claim 6, including a means for adjustment of the linkage length.

* * * * *